US007073331B2

(12) United States Patent
Oda et al.

(10) Patent No.: US 7,073,331 B2
(45) Date of Patent: Jul. 11, 2006

(54) STEAM ENGINE

(75) Inventors: Shuzo Oda, Kariya (JP); Shinichi Yatsuzuka, Chiryu (JP); Katsuya Komaki, Kariya (JP); Yasumasa Hagiwara, Kariya (JP); Toshiyuki Morishita, Nagoya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/132,669

(22) Filed: May 19, 2005

(65) Prior Publication Data

US 2005/0257526 A1 Nov. 24, 2005

(30) Foreign Application Priority Data

May 19, 2004 (JP) ..... 2004-149598

(51) Int. Cl.
*F01B 1/00* (2006.01)

(52) U.S. Cl. ..... 60/508; 60/515

(58) Field of Classification Search ..... 60/508, 60/511, 512, 515
See application file for complete search history.

(56) References Cited

U.S. PATENT DOCUMENTS

| | | | | |
|---|---|---|---|---|
| 4,981,014 | A * | 1/1991 | Gallagher | 60/412 |
| 5,878,571 | A * | 3/1999 | Kleinwachter et al. | 60/520 |
| 2004/0060294 | A1 | 4/2004 | Yatsuzuka et al. | |
| 2005/0193735 | A1* | 9/2005 | Yatsuzuka et al. | 60/670 |
| 2005/0193736 | A1* | 9/2005 | Yatsuzuka et al. | 60/670 |
| 2005/0193737 | A1* | 9/2005 | Oda et al. | 60/670 |

FOREIGN PATENT DOCUMENTS

| | | |
|---|---|---|
| JP | 7-180649 | 7/1995 |

* cited by examiner

*Primary Examiner*—Hoang Nguyen
(74) *Attorney, Agent, or Firm*—Harness, Dickey & Pierce, PLC

(57) ABSTRACT

In a steam engine having a heating device, a cooling device, and an output device, the output device comprises a piston reciprocally moving by a self-excited fluid vibration of a working fluid in a fluid container. The piston is reciprocally moved by the output device for a certain period before starting an operation of the steam engine, so that the working fluid is moved to an inside space of the heating device. Since the working fluid is surely heated and vaporized by the heating device, the fluid vibration is stably started, and as a result, the operation of the steam engine can be smoothly started.

18 Claims, 6 Drawing Sheets

STEAM ENGINE

CROSS REFERENCE TO RELATED APPLICATION

This application is based on Japanese Patent Application No. 2004-149598 filed on May 19, 2004, the disclosure of which is incorporated herein by reference.

FIELD OF THE INVENTION

The present invention relates to a steam engine having a fluid container, in which a working fluid is filled and the working fluid is vibrated in the fluid container in a self-excited vibrating manner as a result of a repeated operation of vaporization and liquefaction of the working fluid by heating and cooling the working fluid.

BACKGROUND OF THE INVENTION

An apparatus for a steam engine is known in the art, for example as disclosed in Japanese Patent Publication No. H7-180649, in which the energy is obtained by repeating vaporization and liquefaction of a fluid.

In the above apparatus, a volatile fluid is filled in a heating chamber, wherein the fluid is vaporized by heating the same and the vaporized fluid is upwardly moved in a vertically arranged fluid pipe. Then, the vaporized fluid is cooled and liquidized in a cooling chamber provided at an upper portion of the fluid pipe. The liquidized fluid is downwardly moved to return to the heating chamber through the fluid pipe. A magnetic member is movably provided in the fluid pipe, so that a reciprocal movement of the magnetic member is generated in response to the movement of the fluid. An electric power is generated by producing an electromotive force at a coil provided at an outside of the fluid pipe.

The applicant of the present invention has proposed a steam engine, as disclosed in Japanese Patent Publication No. 2004-84523 (which corresponds to U.S. Patent Publication No. 2004/0060294 A1). The steam engine is shown in FIG. 9.

The steam engine 500 comprises a fluid container 502 having a U-shaped pipe filled with a working fluid, a heating device 504 for heating the working fluid in the fluid container 502, a cooling device 506 for cooling steam vaporized by the heating device 504, and an output device 508.

The output device 508 comprises a cylinder 510, a piston 512 reciprocating in the cylinder 510, a moving member 514 connected at its one end to the piston 512, and a spring 516 connected at the other end of the moving member 514. The piston 512 moves in the cylinder 510 in a reciprocating manner according to pressure from the working fluid.

In the above steam engine 500, volumetric expansion of the working fluid occurs in the fluid container 502, when the working fluid is heated and vaporized by the heating device 504. The vaporized steam heated by the heating device 504 moves downwardly toward the cooling device 506, at which the steam is cooled and liquidized. Then, the volume of the working fluid in the fluid container 502 is contracted. The piston 512 and the moving member 514 are reciprocated by change of liquid surface (self-excited vibration) as the pressure change due to the volumetric expansion and contraction of the working fluid in the fluid container 502.

For example, a permanent magnet is provided at the moving member 514 and a coil is faced to the permanent magnet, so that electromotive force is generated at the coil by reciprocating the piston 512 and the moving member 514 to generate electric power.

In the steam engine 500 shown in FIG. 9, the heating device 504 is provided above the cooling device 506. Therefore, when the steam engine 500 stops, a liquid surface of the working fluid does not exist, as the case may be, in such a space (of a heating portion), at which the working fluid receives a heat from the heating device 504 during the operation of the steam engine.

In such a case, the stem engine 500 can not be appropriately started.

As a start-up operation of the steam engine, it is known that an operational temperature of the heating device 504 is increased and an operational temperature of the cooling device 506 is decreased before staring the operation of the steam engine, so that the heating operation (vaporization of the working fluid) and the cooling operation (liquefaction of the working fluid) can be smoothly started.

However, if the working fluid does not exist in the space of the heating portion of the heating device, the vaporization of the working fluid can not be sufficiently made even when the operational temperature of the heating device is in advance increased. And thereby, the smooth starting operation of the steam engine can not be realized.

SUMMARY OF THE INVENTION

The present invention is made in view of the above problems, and it is an object of the present invention to provide a steam engine, which is able to appropriately start an operation of the steam engine.

According to a feature of the present invention, a steam engine comprises a fluid container in which a working fluid is filled, a heating and a cooling devices are respectively provided at the fluid container to respectively perform a heating and a cooling operations to the working fluid, and an output device for converting a fluid vibration of the working fluid in the fluid container into a mechanical energy. The output device has a piston reciprocally moving by the fluid vibration, so that the output device can generate electric power by use of the reciprocal movement of the piston. The piston is reciprocally moved by the output device for a certain time period before starting an operation of the steam engine, so that working fluid can be moved up to an inside space of the heating device. Since the working fluid can exist in the inside space of the heating device, as above, the working fluid can be surely and sufficiently heated and vaporized by the heating device, to smoothly start the operation of the steam engine.

According to another feature of the present invention, the output device comprises an electromagnetic coil, at which electromotive force is generated when the piston is reciprocally moved by the fluid vibration during a normal operation of the steam engine, and the steam engine further comprises a piston control unit for controlling the reciprocal movement of the piston before starting the operation of the steam engine, by supplying electric current to the electromagnetic coil to generate an electromagnetic force and thereby to move the piston.

According to a further feature of the present invention, the steam engine further comprises a rotating device for generating a driving force to drive the piston, a mechanical link device for operatively connecting or disconnecting the rotating device to or from the piston, and a piston control unit for controlling the reciprocal movement of the piston before starting the operation of the steam engine, by transmitting the driving force or cutting off the transmission of the driving force to the piston. According to such a feature, the piston can be reciprocally moved by the rotating device before starting the operation of the steam engine.

According to a further feature of the present invention, the steam engine further has a sensor for detecting a temperature of the heating device or an inside fluid pressure of the fluid container, and a piston control unit controls the reciprocal movement of the piston before starting the operation of the steam engine, in accordance with the temperature or the inside fluid pressure detected by the sensor. More specifically, the piston control unit continues the reciprocal movement of the piston for a certain period when the temperature or the fluid pressure reaches at a predetermined value, at which the temperature or the fluid pressure is high enough to continuously operate the fluid vibration by the vaporization and liquefaction of the working fluid, so that the operation of the steam engine can be smoothly started.

According to a further feature of the present invention, a piston control unit controls the reciprocal movement of the piston for the certain time period before starting the operation of the steam engine, when the piston control unit determines that a predetermined period has passed from a time point at which an operation for increasing an operational temperature of the heating device had been started.

According to a still further feature of the present invention, the piston is forcibly moved to and held at a predetermined position (e.g. the bottom dead center), when an operation of the steam engine is stopped, so that working fluid is moved up to an inside space of the heating device. As a result, the working fluid remains in the inside space of the heating device at a starting time of a next operation of the stem engine, and the working fluid is sufficiently heated and vaporized to smoothly start the operation of the steam engine.

According to a still further feature of the present invention, the piston is held for a certain time period at a predetermined position (e.g. the bottom dead center) before starting an operation of the steam engine, so that the working fluid remains in the inside space of the heating device. And an operational temperature of the heating device is increased during the above certain time period in which the piston is held at the predetermined position. As a result, the working fluid can be sufficiently heated and vaporized to smoothly start the operation of the steam engine.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

The embodiments of the present invention will be explained with reference to the drawings.

FIRST EMBODIMENT

Figure 1:
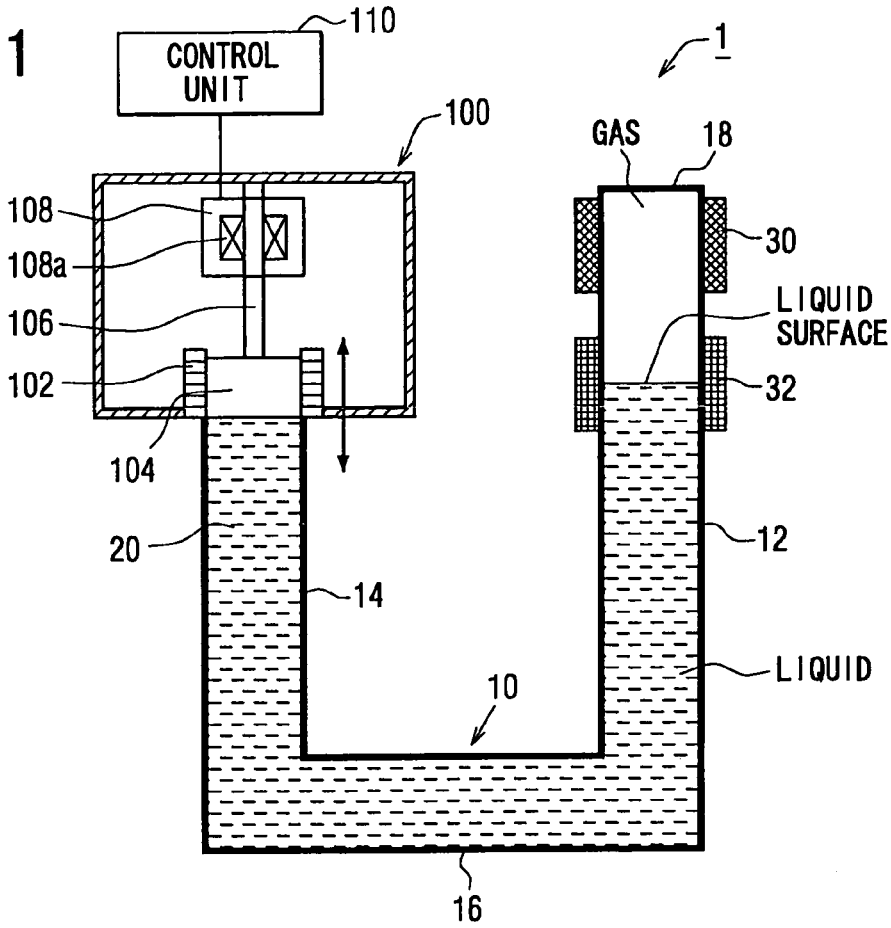
FIG. 1 is a schematic view showing a steam engine according to a first embodiment of the present invention.

FIG. 1 is a schematic view showing a steam engine 1 according to the first embodiment.

As shown in FIG. 1, the steam engine 1 comprises a fluid container 10 in which a liquid-phase working fluid, such as water, is filled with a predetermined pressure, a heating device 30, a cooling device 32, and an output device 100. The fluid container 10 is a U-shaped container comprising a pair of (first and second) vertically extending pipes 12 and 14 and a horizontally extending pipe 16 connecting lower end portions of the vertically extending pipes 12 and 14 with each other. The heating device 30, the cooling device 32, and the output device 100 are arranged in the fluid container 10 in this order.

The heating device 30 comprises, for example, a heat exchanger for partly heating and vaporizing the working fluid in the fluid container 10. The cooling device 32 likewise comprises, for example, a heat exchanger for cooling and liquidizing steam vaporized by the heating device 30. The heating device 30 is arranged at an outer surface adjacent to an upper end portion (a heating portion) 18 of the first vertically extending pipe 12. The heating device 30 heats the working fluid in the heating portion of the first vertically extending pipe 12. The cooling device 32 is arranged at an outer surface (a cooling portion) of the first vertically extending pipe 12 below the heating device 30. The cooling device 32 cools the working fluid in an inner space of the cooling portion of the first vertically extending pipe 12.

Wall portions of the first pipe 12, at which the heating device 30 and the cooling device 32 are arranged, are made of such material having high heat conductivity as copper and aluminum, in order to efficiently heat or cool the working fluid. The other wall portions of the fluid container 10 are preferably made of heat insulating material.

When the working fluid in the fluid container 10 is heated and vaporized by the heating device 30, the volume of the working fluid expands. The vaporized steam heated by the heating device 30 moves downwardly toward the cooling device 32, at which the steam is cooled and liquidized. Then, the volume of the working fluid in the fluid container 10 is contracted. A change of liquid level (self-excited vibration) is generated at an upper end portion 20 of the second vertically extending pipe 14, due to the volumetric expansion and contraction of the working fluid in fluid container 10.

The output device 100 is arranged at the upper end portion 20 of the second vertically extending pipe 14. The output device 100 generates the electric power according to the change of the liquid level (the self-excited vibration) generated at the upper end portion 20.

The output device 100 comprises a cylinder 102 communicated with the upper end portion 20, a piston 104 reciprocating in the cylinder 102, and a moving member 106 connected at its one end to the piston 104.

In the output device 100, the piston 104 reciprocates between one end (bottom dead center) and an opposite end to the fluid container 10 (top dead center), while keeping a contact of the piston 104 with the working fluid in the fluid container 10. A permanent magnet (not shown) is provided to the moving member 106. A stator 108 including a coil 108*a* is provided at a position facing to the permanent magnet. The piston 104 and the moving member 106 are linearly reciprocated by receiving the change of the liquid level of the working fluid in the upper end portion 20. An electromotive force is generated at the coil 108*a* according to the reciprocal movement of the moving member 106, so that the electric power is generated.

A control unit 110, which comprises an ordinary computer and so on, is connected to the coil 108*a*. The control unit 110 is formed to supply a drive current to the coil 108*a* and to control the drive current. Namely, the control unit 110 operates the output device 100 as a starter by supplying an alternating drive current to the coil 108*a*. In this case, the moving member 106 and the piston 104 are reciprocated at a frequency of the alternating current by the interaction between the coil 108*a* and the moving member 106. The change of the liquid level (the self-excited vibration) is generated at the upper end portion 20, after the supply of the drive current by the control unit 110 is cut off. Then, the electromotive force is generated at the coil 108*a* when the piston 104 and the moving member 106 are reciprocated according to the change of the liquid level. In this case, the output device 100 is operated as an electric power generator.

To start an operation of the steam engine 1 by generating the self-excited vibration of the liquid level in the second pipe 14, it is necessary to make the working fluid exist in the heating portion 18 of the heating device 30, so that the working fluid can receive the heat from the heating device 30. If the working fluid can not be vaporized by the heat from the heating device 30, the steam engine 1 can not start its operation.

It is desirable to drive the piston 104 and the moving member 106 by the control unit 110 before starting the operation of the steam engine 1, in order to appropriately start the operation of the steam engine 1 by continuously generating the self-excited vibration of the working fluid in the upper end portion 20.

A starting operation of the steam engine 1 will be explained with reference to a flow chart shown in FIG. 2.

The control unit 110 performs the starting operation of the steam engine 1 when the heating device 30 or the cooling device 32 starts its heating or cooling operation of the working fluid.

Figure 2:
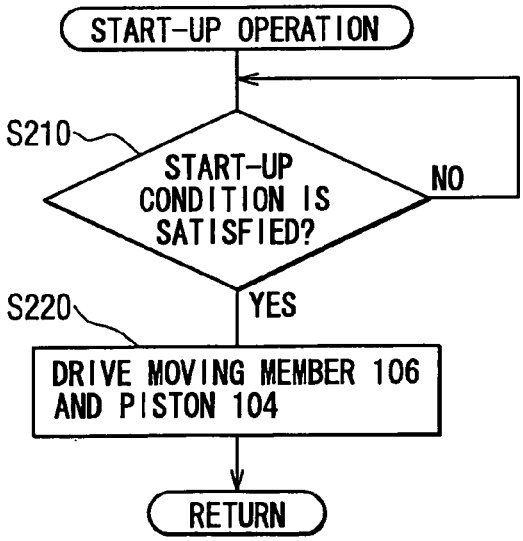
FIG. 2 is a flow chart showing a start-up operation of the steam engine of the first embodiment.

As shown in FIG. 2, when the control unit 110 starts the stating (start-up) operation, it determines at a step S210 whether a start-up condition is satisfied or not, which is a condition to drive the moving member 106 and the piston 104 by supplying the drive current to the coil 108*a* of the output device 100.

The control unit 110 determines that the start-up condition is satisfied, in the case that a predetermined period "ts" has passed from a time point (t1) at which a control for increasing an operational temperature of the heating device 30 has started.

The predetermined period "ts" is a time period starting from the above time point (t1) and ending at a time point (t2) at which the operational temperature of the heating device 30 has been increased enough to continuously keep the operation of self-excited vibration of the working fluid in the fluid container 10, by heating and cooling operations at the heating and the cooling devices 30 and 32. The above time period "ts" can be decided for the respective steam engines based on the experiments and so on, depending on the individual characteristics thereof.

At a step S220, after the predetermined period "ts" has passed, the drive current is supplied to the coil 108*a*, so that the piston 104 is reciprocated during a predetermined period "tp". Then, the self-excited vibration of the working fluid in the fluid container 10 is started being triggered by the reciprocal movement of the piston 104.

The predetermined period "ts" is decided by taking into consideration that the piston 104 is driven to reciprocate by the drive current supply to the output device 100.

When the control unit 110 determines at the step S210 that the start-up condition is satisfied (YES at S210), the process goes to the step S220. When the answer at the step S210 is NO, the process of the step S210 is continued until the start-up condition is satisfied.

At the step S220, as described above, the piston 104 is driven by the drive current for the predetermined period "tp", so that the piston 104 is reciprocated between the top dead center and the bottom dead center. The process of the step S220 is ended, after the predetermined period "tp" has passed.

The liquid surface of the working fluid in the first pipe 12 is upwardly moved to the heating portion, at which the heating device 30 is arranged, when the piston 104 of the output device 100 is moved to the bottom dead center, so that the working fluid can exist in the space of the heating portion.

When the process of the step S220 is performed, the heat from the heating device 30 can be surely supplied to the working fluid.

Furthermore, the process of the step S220 is performed after the predetermined period "ts", which is enough to raise the operational temperature of the heating device 30 to a level in that the moving member 106 and the piston 104 can be continuously reciprocated by the self-excited vibration.

Therefore, after the process of the step S220, the operation of the self-excited vibration of the working fluid is smoothly started in the fluid container 10, and the output device 100 is operated by the fluid vibration. The steam engine 1 can be appropriately started as above.

SECOND EMBODIMENT

The second embodiment of the present invention will be explained with reference to FIG. 3.

The second embodiment is a modification of the first embodiment, and an explanation of those portions which are the same or similar to the first embodiment will be omitted or simplified.

Figure 3:
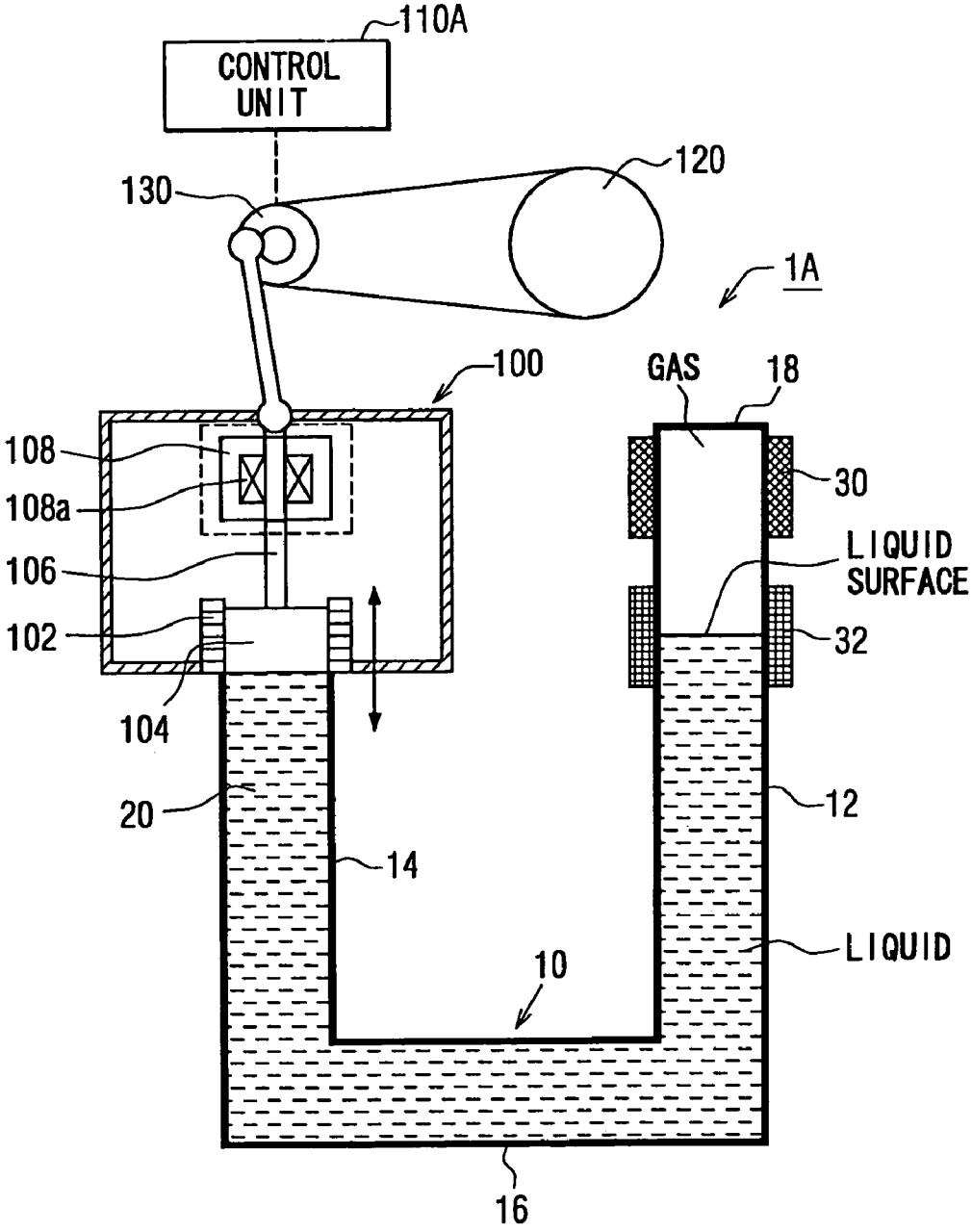
FIG. 3 is a schematic view showing a steam engine according to a second embodiment of the present invention.

FIG. 3 is a schematic view showing a steam engine 1A.

The second embodiment differs from the first embodiment in the following point.

The steam engine 1A of the second embodiment has a rotating device 120 for generating a rotational force and a mechanical link device 130 for converting the rotational force into a reciprocating force and transmitting the reciprocating force to the moving member 106 and piston 104 of the output device 100.

The rotating device 120 is a machine which emits heated gas when generating the rotational force. The heating device 30 heats the working fluid in the fluid container 10 by using the heated gas emitted from the rotating device 120. The rotating device 120 is, for example, an internal combustion engine for a motor vehicle. In the case that the heating device 30 heats the working fluid by using a heat energy of the exhaust gas, the steam engine 1A can be operated more efficiently than the case in which the working fluid is heated by using the heat energy generated by the heating device 30 itself.

The mechanical link device 130 is operatively connected to the output device 100, so that it transmits the driving force or stops the transmission of the driving force from the rotating device 120 to the moving member 106 and piston 104.

A control unit 110A outputs a control signal to the mechanical link device 130 to perform the above connection or disconnection between the rotating device 120 and the output device 100.

The steam engine 1A is operated by the control unit 110A in a manner substantially the same to the first embodiment.

When starting the operation of the steam engine 1A, the control unit 110A at first determines whether the start-up condition is satisfied or not. When the predetermined period "ts" has passed (corresponding to "YES" at the step S210 of FIG. 2), the piston 104 is driven by the rotating device 120 and the link device 130 during the predetermined period "tp".

As above, the operation of the steam engine 1A can be smoothly started as in the same manner to the first embodiment.

THIRD EMBODIMENT

The third embodiment of the present invention will be explained with reference to FIG. 4.

Figure 4:
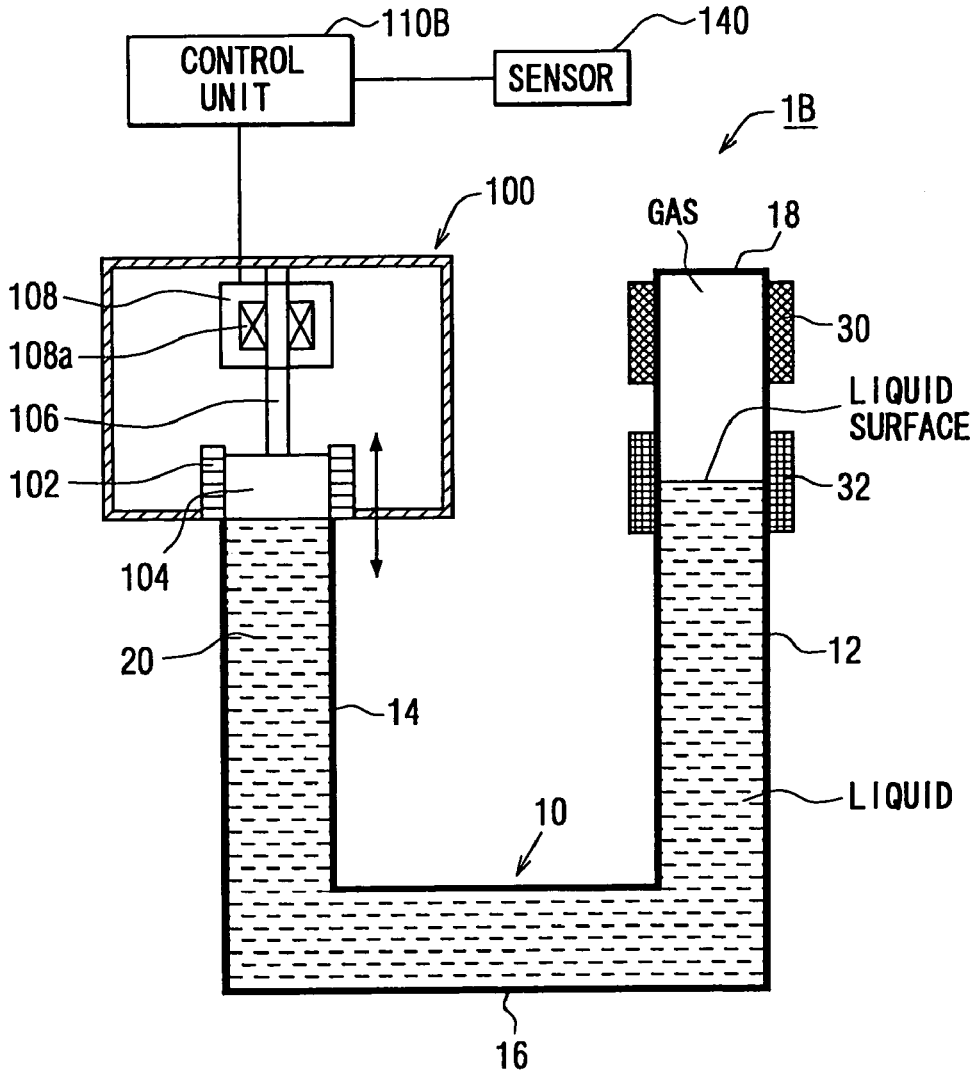
FIG. 4 is a schematic view showing a steam engine according to a third embodiment of the present invention.

FIG. 4 is the schematic view showing a steam engine 1B according to the third embodiment of the present invention, which is a modification of the first embodiment.

A steam engine 1B of the third embodiment has a sensor 140, which detects at least either a temperature of the heating device 30 or a temperature around the upper portion (the heating portion) 18 of the first pipe 12 heated by the heating device 30.

A control unit 110B is connected with the sensor 140, and drives the steam engine 1B by performing the starting operation shown in FIG. 2 based on the temperature detected by the sensor 140.

At the step S210, the control unit 110B determines whether the start-up condition is satisfied or not, based on the temperature detected by the sensor 140, instead of the time "ts" of the first embodiment. Namely, the control unit 110B determines whether the temperature detected by the sensor 140 reaches at a predetermined temperature "Tx". In case of YES at the step S210, the process goes to the step S220, and the control unit 110B drives the coil 108*a*, so that the moving member 106 and piston 104 are moved upwardly and downwardly, as in the same manner to the first embodiment.

The predetermined temperature "Tx" is defined as such a temperature, which is enough to continuously keep the operation of self-excited vibration of the working fluid once the vibration by heating and cooling operations has been started. The predetermined temperature "Tx" can be decided for the respective steam engines according to the characteristic of each of the steam engine 1B through the experiments and so on.

In the case that both of the temperature of the heating device 30 and the temperature of the heating portion 18 of the first pipe 12 are detected, the control unit 110B can be arranged such that it determines whether each of the detected temperatures reaches at the respective predetermined temperatures ("Tx1" and "Tx2"), at which the self-excited vibration can be stably continued.

The sensor 140 is not limited to a detecting means for the temperature, but can be such a detecting means which detects other physical values in place of the temperature of the heating device 30.

For example, the sensor 140 may detect a pressure in the fluid container 10. The control unit 110B determines whether the pressure detected by the sensor 140 reaches at a predetermined pressure "Px".

The predetermined pressure "Px" is defined as such a pressure, which is enough to continuously keep the self-excited vibration of the working fluid in the fluid container 10, once the fluid vibration by heating and cooling operation has been started. The predetermined pressure "Px" can be likewise decided for the respective steam engines according to the characteristic of each of the steam engine 1B.

The third embodiment (FIG. 4) can be combined to the second embodiment of FIG. 3. Namely, the control unit 110A and the rotating device 120 as well as the link device 130 of the second embodiment can be used in the place of the control unit 110B of FIG. 4.

In such a modified steam engine 1B, the moving member 106 and the piston 104 are disconnected from the link device 130 until the temperature (or pressure) detected by the sensor 140 reaches at the predetermined temperature "Tx" (or the predetermined pressure "Px") (corresponding to the step S210 of FIG. 2).

At a next step (corresponding to the step S220 of FIG. 2), the control unit 110B outputs the control signal to the mechanical link device 130, so that the moving member 106 and the piston 104 are moved upwardly and downwardly by the driving force from the rotating device 120, during the predetermined period ("tp").

After the process of the step S220 is finished, the moving member 106 and the piston 104 are continuously reciprocated by the self-excited vibration of the working fluid generated in the fluid container 10, and the output device 100 is operated as the electric power generator. The steam engine 1B can be also appropriately started as above.

FOURTH EMBODIMENT

The fourth embodiment of the present invention will be explained with reference to FIG. 5.

The fourth embodiment is a modification of the first embodiment, which differs from the first embodiment in the following point.

A structure of the steam engine of the fourth embodiment is the same to that of the first embodiment (FIG. 1). However, the control unit 110 controls an operation of the steam engine 1 in accordance with a flow chart shown in FIG. 5, in place of the starting operation shown in FIG. 2.

The control unit 110 holds the piston 104 and the moving member 106 at a desired position (the bottom dead center) by outputting the control signal to the output device 100.

In the steam engine of this embodiment, the piston 104 is moved to the bottom dead center (the lowermost position in FIG. 1) by its own weight, when the operation of the steam engine is stopped. When the piston 104 is at its bottom dead center, the working fluid exists in the space of the heating portion of the first pipe 12.

Figure 5:
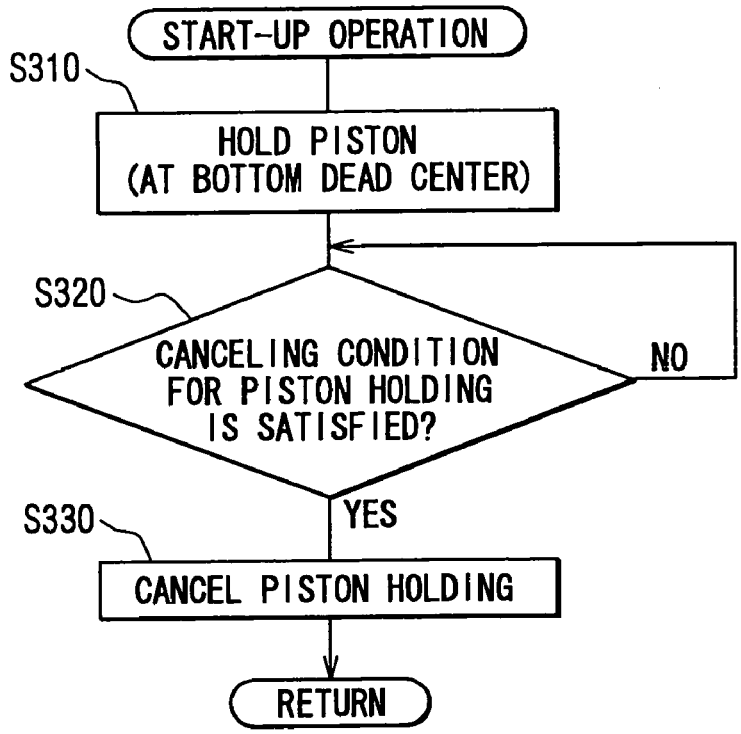
FIG. 5 is a flow chart showing a start-up operation of a fourth embodiment.

The control unit 110 starts a process of the flowchart shown in FIG. 5, when the heating device 30 or the cooling device 32 begins its heating or cooling operation.

At a step S310, the control unit 110 outputs a holding signal to the coil 108*a* to hold the piston 104 at the bottom dead center, so that the working fluid is maintained in the space of the heating portion 18 of the first pipe 12 and is heated by the heating device 30.

At a step S320, the control unit 110 determines whether a canceling condition is satisfied, which is a condition for canceling a piston holding operation by the step S310.

More specifically, the control unit 110 determines whether a predetermined period "tc" has passed or not from a time point (t3) at which the heating device 30 had started its heating operation for the working fluid.

The predetermined period "tc" is a time period starting from the above time point (t3) and ending at a time point (t4) at which the operational temperature of the heating device 30 has been increased enough to continuously maintain the operation of the self-excited vibration of the working fluid in the fluid container 10, by heating and cooling operations at the heating and cooling devices 30 and 32. The predetermined period "tc" can be decided for the respective steam engines, as in the same manner to the above embodiments.

During the predetermined period "tc", namely until the piston holding condition is canceled at the step S320, the piston 104 is held at its bottom dead center. Accordingly, the working fluid is efficiently heated by the heating device 30 and is vaporized. Thus, a larger amount of high-pressure steam is generated in the first pipe 12 of the fluid container 10 until the canceling condition is satisfied.

As described below, when the holding operation for the piston 104 is canceled at a step S330, the piston 104 is strongly moved upwardly by the pressure of the large amount of high-pressure steam, to smoothly start the fluid vibration.

The predetermined period "tc" is, therefore, decided by taking into consideration such a strong driving force by the large amount of the high-pressure steam.

At the step S320, when the control unit 110 determines that the canceling condition is satisfied, that is, the predetermined period "tc" has passed (YES at the step S320), the process goes to the step S330.

At the step S330, the control unit 110 cancels the piston holding operation by outputting a control (cancel) signal to the output device 100, and then, it finishes the start-up operation.

When the control unit 110 finishes the step S330, the moving member 106 and the piston 104 are continuously reciprocated by the self-excited vibration of the working fluid in the fluid container 10, to start the electric power generation at the output device 100. As above, the steam engine can be smoothly started.

The control unit 110 of the fourth embodiment can be connected to the sensor 140, as the control unit 110B shown in FIG. 4. The sensor 140 detects at least one of temperatures at the heating device 30 or the heating portion 18, or detects the inside fluid pressure of the first pipe 12.

The control unit 110 of such a modification can also drive the steam engine in accordance with the start-up operation shown in FIG. 5 based on the temperature (or the inside fluid pressure) detected by the sensor 140.

Figure 6:
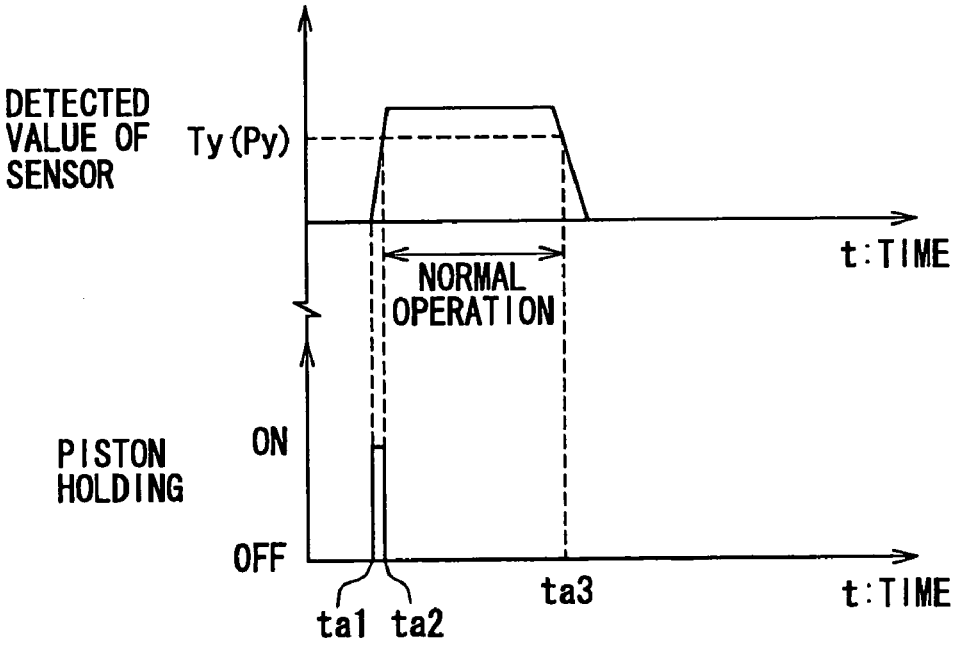
FIG. 6 is a timing chart showing a relation between a detected value by a sensor and a piston holding operation, with respect to a time change, according to the fourth embodiment.

The driving operation is explained with reference to the flow chart shown in FIG. 5 and a timing chart shown in FIG. 6. FIG. 6 is the timing chart showing a relation between the detected value (the temperature or the inside fluid pressure) by the sensor 140 and the holding operation for the piston 104 with respect to a time change.

The control unit 110 performs the process substantially equal to the steps S310 to S330 of FIG. 5. The control unit 110, however, performs the step S320 based on the temperature (or the inside fluid pressure) detected by the sensor 140.

As shown in FIG. 6, the control unit 110 starts a process at a time "ta1". The control unit 110 starts the piston holding operation in accordance with the step S310 and continues the piston holding operation until a time "ta2", at which the temperature (or the inside fluid pressure) detected by the sensor 140 reaches at a predetermined temperature "Ty" (or a predetermined pressure "Py"). At the time "ta2", the control unit 110 determines that the canceling condition is satisfied (YES at the step S320), and the control unit 110 cancels the piston holding operation at the step S330.

The predetermined temperature "Ty" (or the predetermined pressure "Py") can be decided as in the same manner to the third embodiment.

When the holding operation for the piston 104 is canceled at the step S330 (at the time "ta2"), the piston 104 is strongly moved upwardly by the pressure of the large amount of high-pressure steam in the heating portion 18, so that the fluid vibration in the fluid container 10 can be smoothly started. The predetermined temperature "Ty" (or the predetermined pressure "Py") is, however, decided by taking into consideration such a strong driving force of the large amount of the high-pressure steam.

When the control unit 110 finishes the step S330, the self-excited vibration of the working fluid in the fluid container 10 is started, so that the output device 100 starts its electric power generation. As above, the steam engine can be smoothly started.

After the control unit 110 finishes the step S330, the operation of the steam engine is continued for an intended period, and the heating device 30 and the cooling device 32 stop the heating and cooling operations, to stop the operation of the steam engine.

Then, the self-excited vibration of the working fluid in the fluid container 10 is stopped after the temperature (or the inside fluid pressure) becomes lower than the predetermined temperature "Ty" (or the pressure "Py") (after the time "ta3"), and the reciprocating movement of the moving member 106 and the piston 104 are stopped. The piston 104 is moved to the bottom dead center by its own weight.

FIFTH EMBODIMENT

The fifth embodiment of the present invention will be explained with reference to FIG. 7.

The fifth embodiment is a modification of the fourth embodiment, and differs from the fourth embodiment in the following point.

A structure of the steam engine of the fifth embodiment is basically the same to that of the first embodiment (FIG. 1). However, the control unit 110 controls an operation of the steam engine, in accordance with a flow chart shown in FIG. 7, in place of the start-up operation shown in FIG. 5.

In the fifth embodiment, when the steam engine stops, the piston 104 is moved to and held at the bottom dead center not by its own weight but by a control signal to the coil 108*a* from the control unit 110.

Figure 7:
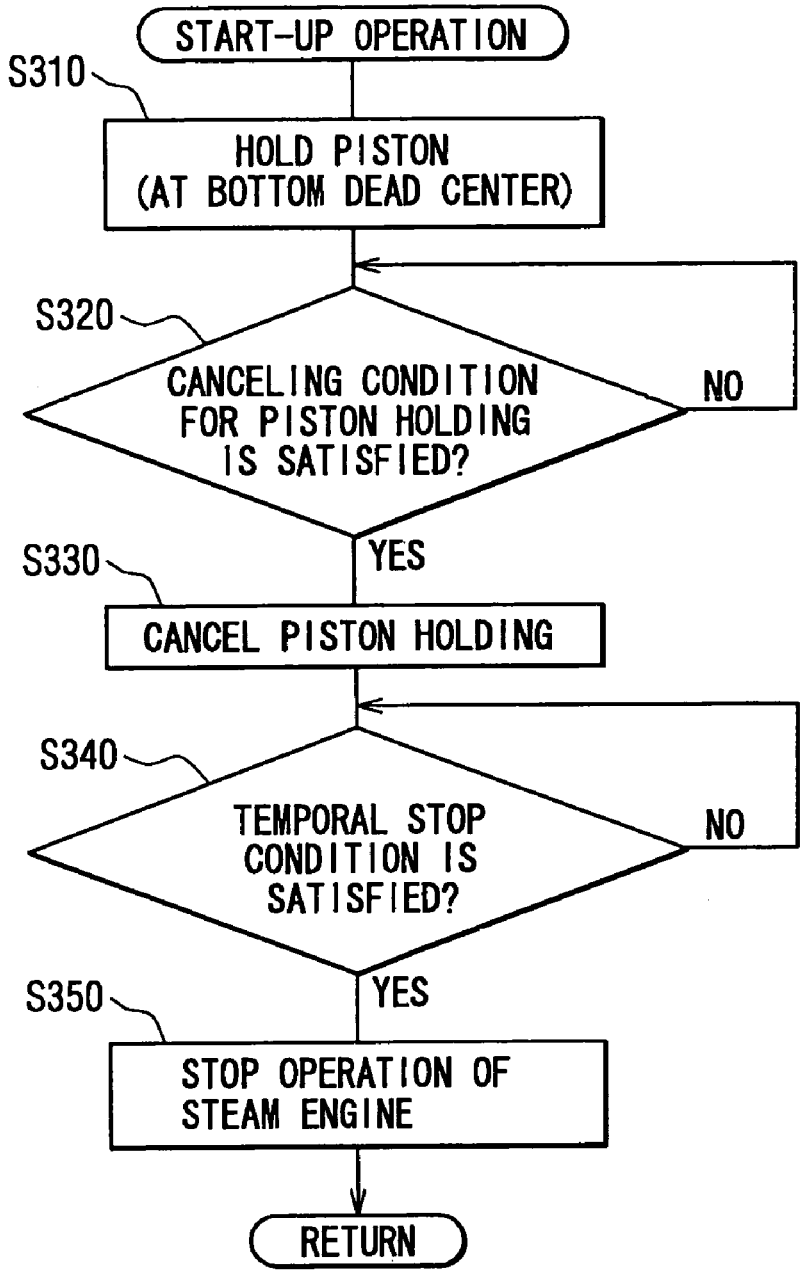
FIG. 7 is a flow chart showing a start-up operation of a fifth embodiment.

In FIG. 7, the steps S310 to S330 are the same to those in FIG. 5.

At a step S340, the control unit 110 determines whether a temporal stop condition, which is a condition that the operation of the steam engine is temporally stopped, is satisfied or not.

The control unit 110 determines that the temporal stop condition is satisfied when the self-excited vibration of the working fluid in the fluid container 10 becomes unstable due to any reason, and thereby it becomes difficult to continue the desired stable operation of the steam engine.

The control unit 110 is so designed as to detect an amount of the electric power generated at the output device 100, in order to detect the unstable operation of the steam engine. When the heating device 30 or the cooling device 32 stops its heating or cooling operation due to some reason, or when the heating or cooling operation becomes insufficient or unstable, the self-excited vibration of the working fluid in the fluid container 10 becomes unstable and will be finally stopped. Accordingly, when the generated amount of the electric power becomes lower than a predetermined threshold level, the control unit 110 determines that the temporal stop condition is satisfied.

At the step S340, when the control unit 110 determines that the temporal stop condition is satisfied (YES at the step S340), the process goes to a step S350.

At the step S350, the control unit 110 forcibly stops the operation of the heating and cooling devices 30 and 32 to stop the operation of the steam engine. Further, the control unit 110 drives the coil 108*a* to move the piston 104 downwardly to its bottom dead center and keeps the piston at the bottom dead center. The piston 104 is kept at the bottom dead center until the operation of the steam engine is re-started. When it is re-started, the control process starts with the step S310 of FIG. 7, so that the piston 104 is still kept at the bottom dead center. The piston holding operation is canceled at the step S330, only when the canceling condition is satisfied, at which the steam engine is ready to smoothly start its operation.

At the step S350, since the piston 104 is moved to the bottom dead center and kept at the same position, the working fluid surely exists in the heating portion 18, so that the re-start of the operation of the steam engine can be surely and smoothly done.

For the purpose of surely and smoothly re-starting the operation of the steam engine, the sensor 140 (which is described in the third embodiment of FIG. 4) can be connected to the control unit 110.

The control unit 110 of such a modification drives the steam engine by performing the same process as the start-up operation shown in FIG. 7.

Figure 8:
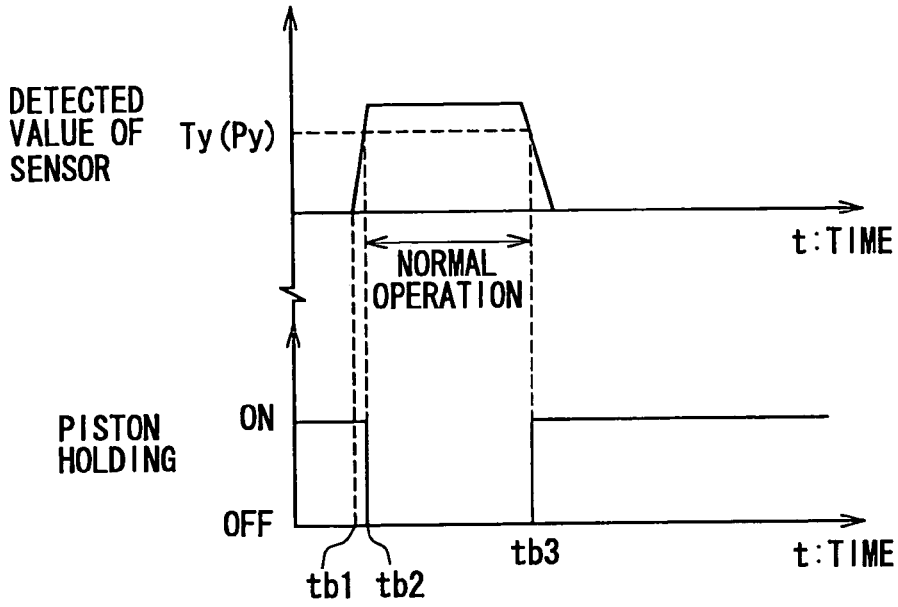
FIG. 8 is a timing chart showing a relation between a detected value by a sensor and a piston holding operation, with respect to a time change, according to the fifth embodiment.
Figure 9:
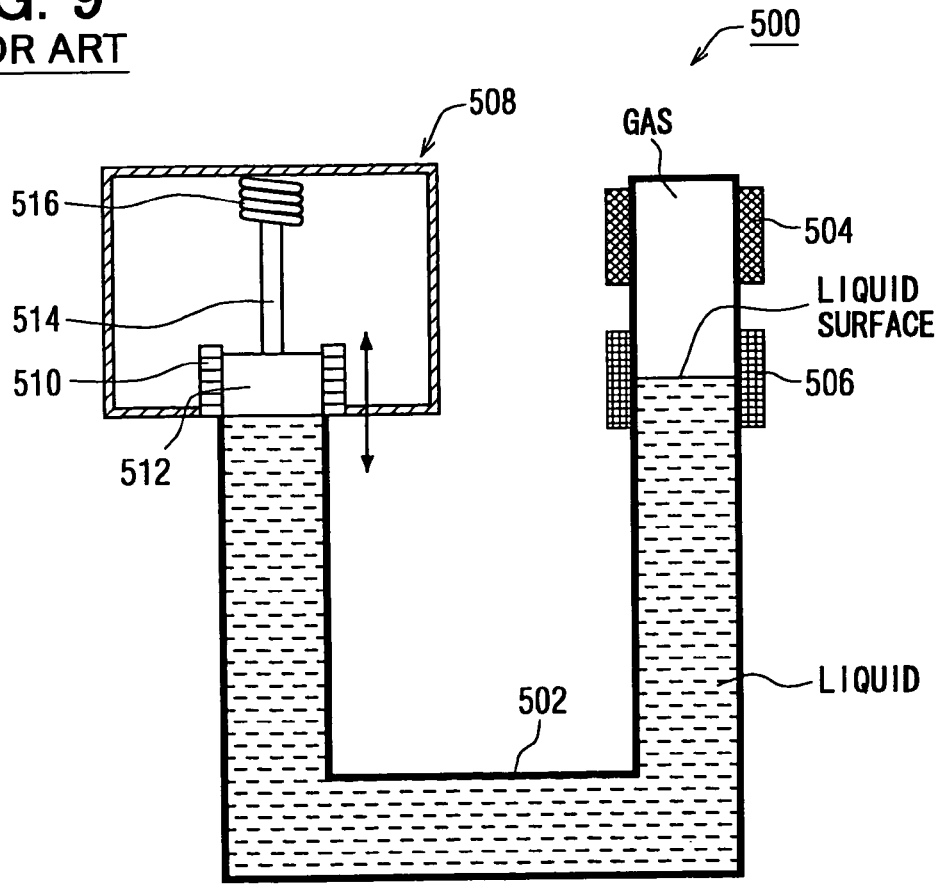
FIG. 9 PRIOR ART
FIG. 9 is a schematic view showing a steam engine according to a prior art.

The start-up operation will be explained with reference to FIG. 7 and FIG. 8. FIG. 8 is a timing chart showing a relation between a detected value (the temperature of the heating device or the inside fluid pressure) at the sensor and the moving and holding operation of the piston, with respect to a time change.

As shown in FIG. 8, the control unit 110 starts the process of the step S310 at the time "tb1", and the control unit 110 continues the piston holding operation performed at the step S350 of the previous operation of the steam engine.

The control unit 110 continues the piston holding operation by the time "tb2", at which the temperature or the pressure detected by the sensor 140 reaches at the predetermined temperature "Ty" or pressure "Py".

Then, at the time "tb2", the control unit 110 cancels the piston holding operation at the step S330.

The control unit 110 continues the canceled condition by a time "tb3", at which the self-excited vibration of the working fluid in the fluid container 10 is stopped.

Namely, the control unit 110 determines at the step S340 that the temporal stop condition is satisfied, because and when the temperature or pressure detected by the sensor 140 becomes lower than the predetermined temperature "Ty" or pressure "Py" and the stable fluid vibration becomes difficult.

When the control unit determines that the temporal stop condition is satisfied at the time "tb3" (YES at the step S340), the piston 140 is moved to the bottom dead center, and the control unit 110 continues to keep the piston 104 at the bottom dead center (at the step S350).

The predetermined temperature "Ty" or pressure "Py" is decided as in the same manner to the third embodiment.

As described above, when the control unit 110 performs the start-up operation shown in FIG. 7 based on the temperature or the pressure detected by the sensor 140 at a start timing (or a re-starting time) of the steam engine (at the step S310), the piston 104 is held at the bottom dead center. Accordingly, a large amount of high-pressure steam is generated in the fluid container 10 until the control unit 110 determines that the canceling condition is satisfied (at the step S320). When the piston holding operation is canceled at the step S330, the steam engine can be smoothly started.

What is claimed is:

1. A steam engine comprising:

a fluid container in which a working fluid is filled;

a heating device for heating the working fluid in the fluid container and vaporizing the working fluid;

a cooling device for cooling down and liquidizing the steam vaporized by the heating device;

an output device for producing a mechanical energy from self-excited fluid vibration of the working fluid generated by a repeated operation of vaporization of the working fluid by the heating device and liquefaction of the working fluid by the cooling device, the output device having a piston reciprocally held in the output device and the piston being operatively in contact with the working fluid so that the piston is reciprocally moved by the self-excited movement of the working fluid; the output device further having an electromagnetic coil, at which electromotive force is generated when the piston is reciprocally moved by the fluid vibration, and a piston control unit for controlling reciprocal movement of the piston before starting operation of the steam engine, by supplying electric current to the electromagnetic coil to generate an electromagnetic force and thereby to move the piston; wherein the heating device, the cooling device, and the output device are arranged in this order, and the piston is reciprocally moved for a certain time period before starting the operation of the steam engine by the piston control unit, so that working fluid can be moved up to an inside space of the heating device.

2. A steam engine comprising:

a fluid container in which a working fluid is filled;

a heating device for heating the working fluid in the fluid container and vaporizing the working fluid;

a cooling device for cooling down and liquidizing the steam vaporized by the heating device;

an output device for producing a mechanical energy from self-excited fluid vibration of the working fluid generated by a repeated operation of vaporization of the working fluid by the heating device and liquefaction of the working fluid by the cooling device, the output device having a piston reciprocally held in the output device and the piston being operatively in contact with the working fluid so that the piston is reciprocally moved by the self-excited movement of the working fluid;

a rotating device for generating a driving force to drive the piston;

a mechanical link device for operatively connecting or disconnecting the rotating device to or from the piston; and a piston control unit for controlling reciprocal movement of the piston before starting operation of the steam engine, by transmitting the driving force or cutting off the transmission of the driving force to the piston; wherein the heating device, the cooling device, and the output device are arranged in this order, and the piston is reciprocally moved for a certain time period before starting the operation of the steam engine by the piston control unit, so that working fluid can be moved up to an inside space of the heating device.

3. A steam engine according to claim 2, wherein the rotating device emits a heated gas, when generating the driving force, and the heating device heats the working fluid in the fluid container by using the heated gas from the rotating device.

4. A steam engine according to claim 1, further comprising:

a temperature sensor for detecting at least one of temperatures of the heating device or of the inner space thereof;

wherein the piston control unit controls the reciprocal movement of the piston before starting the operation of the steam engine, in accordance with the temperature detected by the temperature sensor.

5. A steam engine according to claim 4, wherein the piston control unit controls the reciprocal movement of the piston for the certain time period before starting the operation of the steam engine, when the piston control unit determines that the detected temperature by the temperature sensor has reached at a predetermined temperature, which is enough to continuously perform the fluid vibration by the heating and cooling operations of the heating and cooling devices.

6. A steam engine according to claim 1, further comprising:

a pressure sensor for detecting a fluid pressure in the fluid container;

wherein the piston control unit controls the reciprocal movement of the piston before starting the operation of the steam engine, in accordance with the fluid pressure detected by the pressure sensor.

7. A steam engine according to claim 6, wherein the piston control unit controls the reciprocal movement of the piston for the certain time period before starting the operation of the steam engine, when the piston control unit determines that the detected fluid pressure by the pressure sensor has reached at a predetermined pressure, which is enough to continuously perform the fluid vibration by the heating and cooling operations of the heating and cooling devices.

8. A steam engine according to claim 1, wherein the piston control unit controls the reciprocal movement of the piston for the certain time period before starting the operation of the steam engine, when the piston control unit determines that a predetermined period has passed from a time point at which an operation for increasing an operational temperature of the heating device had been started.

9. A steam engine comprising:

a fluid container in which a working fluid is filled;

a heating device for heating the working fluid in the fluid container and vaporizing the working fluid;

a cooling device for cooling down and liquidizing the steam vaporized by the heating device; and an output device for producing a mechanical energy from self-excited fluid vibration of the working fluid generated by a repeated operation of vaporization of the working fluid by the heating device and liquefaction of the working fluid by the cooling device, the output device having a piston reciprocally held in the output device and the piston being operatively in contact with the working fluid so that the piston is reciprocally moved by the self-excited movement of the working fluid; and a piston control unit for forcibly moving the piston to a predetermined position, when an operation of the steam engine is stopped, so that working fluid is moved up to an inside space of the heating device; wherein the heating device, the cooling device, and the output device are arranged in this order, and the piston control unit holds the piston at the predetermined position after the operation of the steam engine has been stopped, so that the working fluid remains in the inside space of the heating device at a starting time of a next operation of the steam engine.

10. A steam engine comprising:

a fluid container in which a working fluid is filled;

a heating device for heating the working fluid in the fluid container and vaporizing the working fluid;

a cooling device for cooling down and liquidizing the steam vaporized by the heating device;

an output device for producing mechanical energy from self-excited fluid vibration of the working fluid generated by a repeated operation of vaporization of the working fluid by the heating device and liquefaction of the working fluid by the cooling device, the output device having a piston reciprocally held in the output device and the piston being operatively in contact with the working fluid so that the piston is reciprocally moved by the self-excited movement of the working fluid;

a piston control unit for holding the piston at a predetermined position before starting an operation of the steam engine, and increasing an operational temperature of the heating device during a period in which the piston is held at the predetermined position; and a temperature sensor for detecting at least one of temperatures of the heating device or of the inner space thereof; wherein the heating device, the cooling device, and the output device are arranged in this order; and the piston holding condition is canceled by the piston control unit, when the temperature detected by the temperature sensor reaches a predetermined temperature.

11. A steam engine according to claim 10, wherein the predetermined temperature is such a temperature which is enough to continuously perform the fluid vibration by the heating and cooling operations of the heating and cooling devices.

12. A steam engine comprising:

a fluid container in which a working fluid is filled;

a heating device for heating the working fluid in the fluid container and vaporizing the working fluid;

a cooling device for cooling down and liquidizing the steam vaporized by the heating device;

an output device for producing a mechanical energy from self-excited fluid vibration of the working fluid generated by a repeated operation of vaporization of the working fluid by the heating device and liquefaction of the working fluid by the cooling device, the output device having a piston reciprocally held in the output device and the piston being operatively in contact with the working fluid so that the piston is reciprocally moved by the self-excited movement of the working fluid;

a piston control unit for holding the piston at a predetermined position before starting an operation of the steam engine, and increasing an operational temperature of the heating device during a period in which the piston is held at the predetermined position; and a pressure sensor for detecting a fluid pressure in fluid container; wherein the heating device, the cooling device, and the output device are arranged in this order; and the piston holding condition is canceled by the piston control unit, when the fluid pressure detected by the pressure sensor reaches at a predetermined pressure.

13. A steam engine according to claim 12, wherein the predetermined pressure is such a pressure which is enough to continuously perform the fluid vibration by the heating and cooling operations of the heating and cooling devices.

14. A steam engine comprising:

a fluid container in which a working fluid is filled;

a heating device for heating the working fluid in the fluid container and vaporizing the working fluid;

a cooling device for cooling down and liquidizing the steam vaporized by the heating device;

an output device for producing a mechanical energy from self-excited fluid vibration of the working fluid generated by a repeated operation of vaporization of the working fluid by the heating device and liquefaction of the working fluid by the cooling device, the output device having a piston reciprocally held in the output device and the piston being operatively in contact with the working fluid so that the piston is reciprocally moved by the self-excited movement of the working fluid;

a piston control unit for holding the piston at a predetermined position before starting an operation of the steam engine, and increasing an operational temperature of the heating device during a period in which the piston is held at the predetermined position; wherein the heating device, the cooling device, and the output device are arranged in this order; and the piston holding condition is canceled, when a predetermined period has passed from a time point at which an operation for increasing an operational temperature of the heating device had been started.

15. A steam engine according to claim 1, wherein the heating device is provided above the cooling device in a vertical direction.

16. A steam engine according to claim 9, wherein the heating device is provided above the cooling device in a vertical direction.

17. A steam engine according to claim 10, wherein the heating device is provided above the cooling device in a vertical direction.

18. A method for operating a steam engine, the steam engine comprising:

a fluid container in which a working fluid is filled;

a heating device for heating the working fluid in the fluid container and vaporizing the working fluid;

a cooling device for cooling down and liquidizing the steam vaporized by the heating device;

an output device for producing a mechanical energy from self-excited fluid vibration of the working fluid generated by a repeated operation of vaporization of the working fluid by the heating device and liquefaction of the working fluid by the cooling device, the output device having a piston reciprocally held in the output device and the piston being operatively in contact with the working fluid so that the piston is reciprocally moved by the self-excited movement of the working fluid, the output device further having an electromagnetic coil, at which electromotive force is generated when the piston is reciprocally moved by the fluid vibration, wherein the heating device, the cooling device, and the output device are arranged in this order; and a piston control unit for controlling the reciprocal movement of the piston before starting the operation of the steam engine, by supplying electric current to the electromagnetic coil to generate an electromagnetic force and thereby to move the piston; wherein the method for operating the steam engine comprises reciprocally moving the piston by the piston control unit for a certain time period before starting operation of the steam engine, so that working fluid can be moved up to an inside space of the heating device.

* * * * *